US007984723B2

(12) United States Patent
Seivert et al.

(10) Patent No.: US 7,984,723 B2
(45) Date of Patent: Jul. 26, 2011

(54) SELF-STANDING WALKING CANE

(75) Inventors: Chester E. Seivert, South Jordan, UT (US); F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 0 days.

(21) Appl. No.: 12/556,444

(22) Filed: Sep. 9, 2009

(65) Prior Publication Data

US 2011/0056528 A1 Mar. 10, 2011

(51) Int. Cl.
*A45B 9/02* (2006.01)
*A61H 3/02* (2006.01)

(52) U.S. Cl. ..... 135/66; 135/65; 135/72; 135/77; 16/430

(58) Field of Classification Search ..... 135/65–66, 135/77, 71–72, 84; 280/819, 821, 823; D3/5–17; 16/430; 5/81.1 R, 662; 482/75–76
See application file for complete search history.

(56) References Cited

U.S. PATENT DOCUMENTS

| | | | | |
|---|---|---|---|---|
| 1,145,994 | A * | 7/1915 | Jasinski | 248/155.1 |
| D113,534 | S | 2/1939 | Bodkin | |
| D113,865 | S * | 3/1939 | Fletcher | D3/7 |
| D138,330 | S | 7/1944 | Wisecarver | |
| 2,812,950 | A | 11/1957 | Holloway | |
| D199,720 | S | 12/1964 | Wainerdi | |
| D213,537 | S | 3/1969 | Parry | |
| 5,433,234 | A | 7/1995 | Lapere | |
| 5,755,245 | A | 5/1998 | Van Helvoort | |
| 6,220,262 | B1 | 4/2001 | Hasebe | |
| D441,950 | S * | 5/2001 | Suen | D3/7 |
| 6,488,042 | B2 | 12/2002 | Troyer | |
| 6,651,684 | B2 | 11/2003 | Spitzer | |
| 7,316,449 | B2 | 1/2008 | Lynch et al. | |
| 7,418,972 | B2 * | 9/2008 | Reeves | 135/66 |
| 2004/0226593 | A1 * | 11/2004 | Robitaille et al. | 135/77 |
| 2005/0242630 | A1 * | 11/2005 | Miller | 297/4 |
| 2010/0154849 | A1 * | 6/2010 | Schulz et al. | 135/65 |

FOREIGN PATENT DOCUMENTS

EP 591590 A1 * 4/1994

* cited by examiner

*Primary Examiner* — Winnie Yip
(74) *Attorney, Agent, or Firm* — Stoel Rives LLP

(57) ABSTRACT

A walking cane that can be stored in a novel manner is provided. The walking cane may include a non-articulating handle portion and a shaft portion extending from the handle portion. The handle portion is shaped in such a manner as to allow the walking cane to be self-standing when it is inverted and the handle portion is placed on the ground.

15 Claims, 4 Drawing Sheets

SELF-STANDING WALKING CANE

TECHNICAL FIELD

The present disclosure relates generally to mobility assistance devices. More specifically, the present disclosure relates to assistance devices, such as walking canes, that can be stored in a novel manner.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the invention, as claimed, but is merely representative of various embodiments. While the various aspects of the embodiments are presented in drawings, the drawings are not necessarily drawn to scale unless specifically indicated.

The phrases "connected to," "coupled to" and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Figure 1:
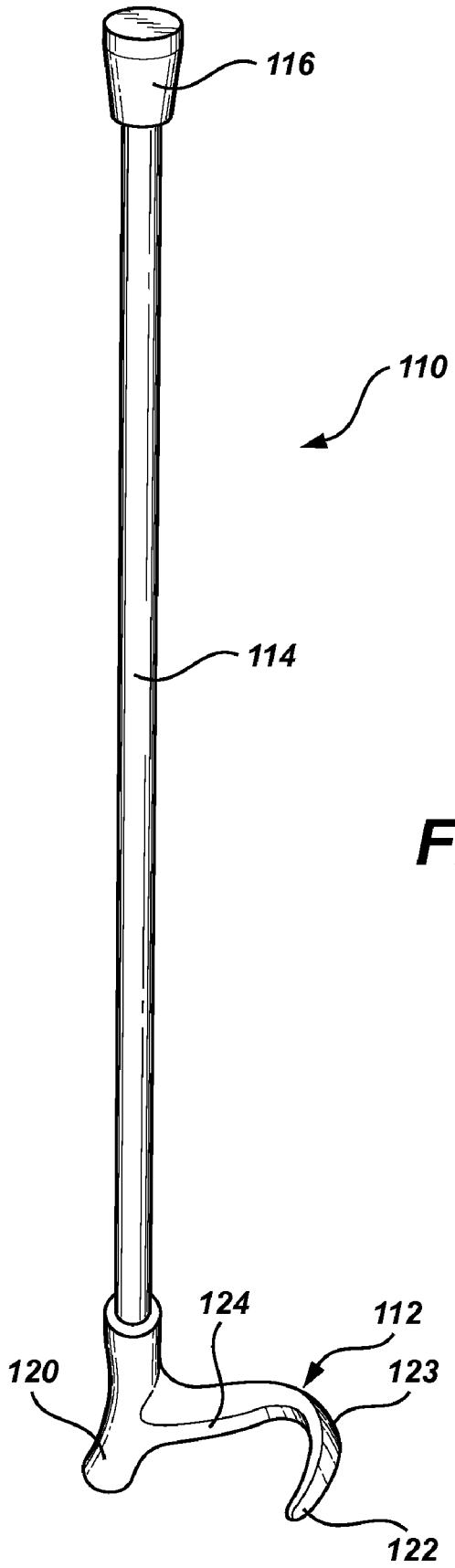
FIG. 1 is a perspective view of one embodiment of a walking cane in a self-standing and inverted position.
Figure 2:
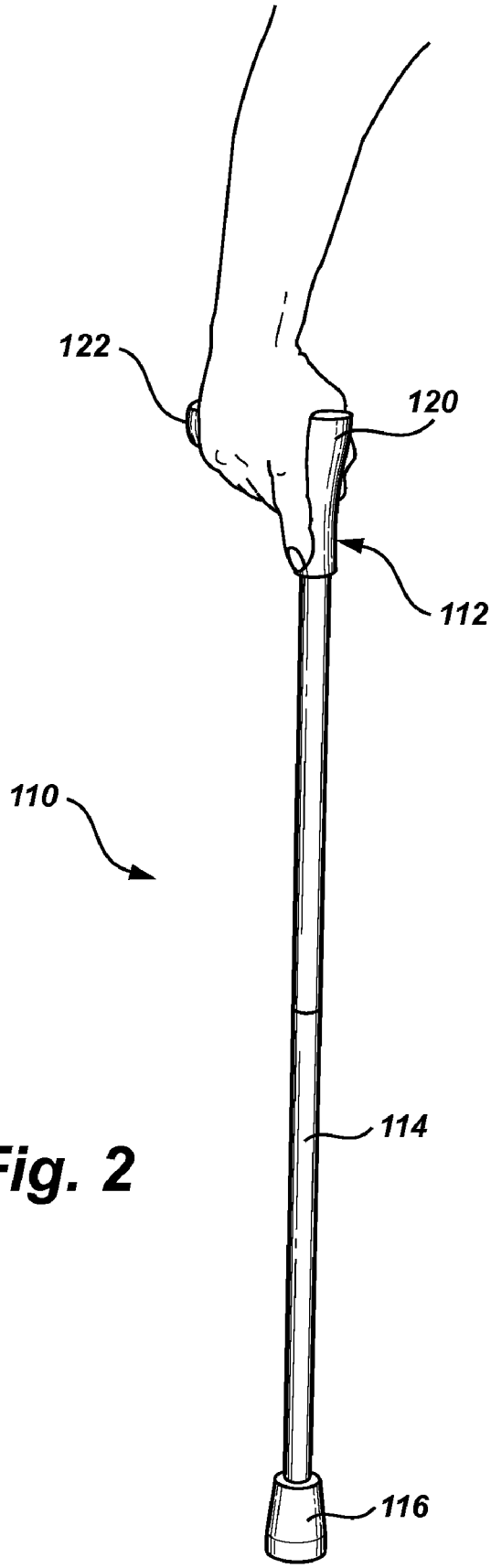
FIG. 2 is a perspective view of one embodiment of a walking cane, while in use.

Referring collectively to FIGS. 1-7, several embodiment of a walking cane 110 are shown. The walking cane 110 includes a handle portion 112 coupled to a shaft portion 114. The handle portion 112 may provide a sturdy ergonomic grip for a user and could be shaped in a way to limit strain on a user's wrist. The shaft portion 114 extends away from the handle portion 112, and extends in the space between the handle portion 112 and the ground when in use. The shaft portion 114 is a longitudinal member, which in some embodiments includes a straight section. In one exemplary embodiment as shown in FIG. 2, the shaft portion 114 is comprised of multiple components that can be telescoping in nature to adjust the height of the walking cane 110. At the distal end of the shaft portion 114, a rubber tip 116 may be disposed to reduce slippage of the walking cane 110 while in use.

The walking cane 110 of the present disclosure provides a practical improvement over known devices. In one aspect, the walking cane 110 can be inverted, i.e., the handle portion 112 is positioned downward, and placed on the ground or similar surface to be free-standing. In the storage, or self-standing position, the handle portion 112 is resting on the ground and the shaft portion 114 extends upward from the ground in a substantially perpendicular fashion.

Figure 3:
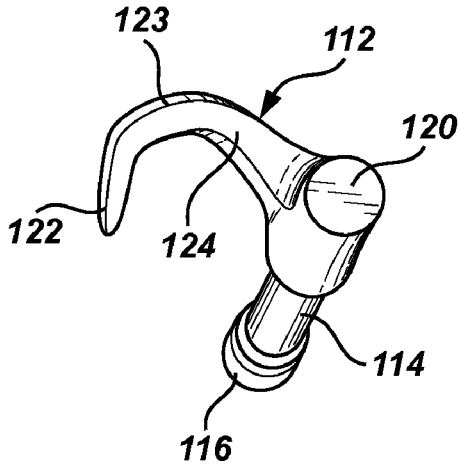
FIG. 3 is a top view of one embodiment of a walking cane.
Figure 4:
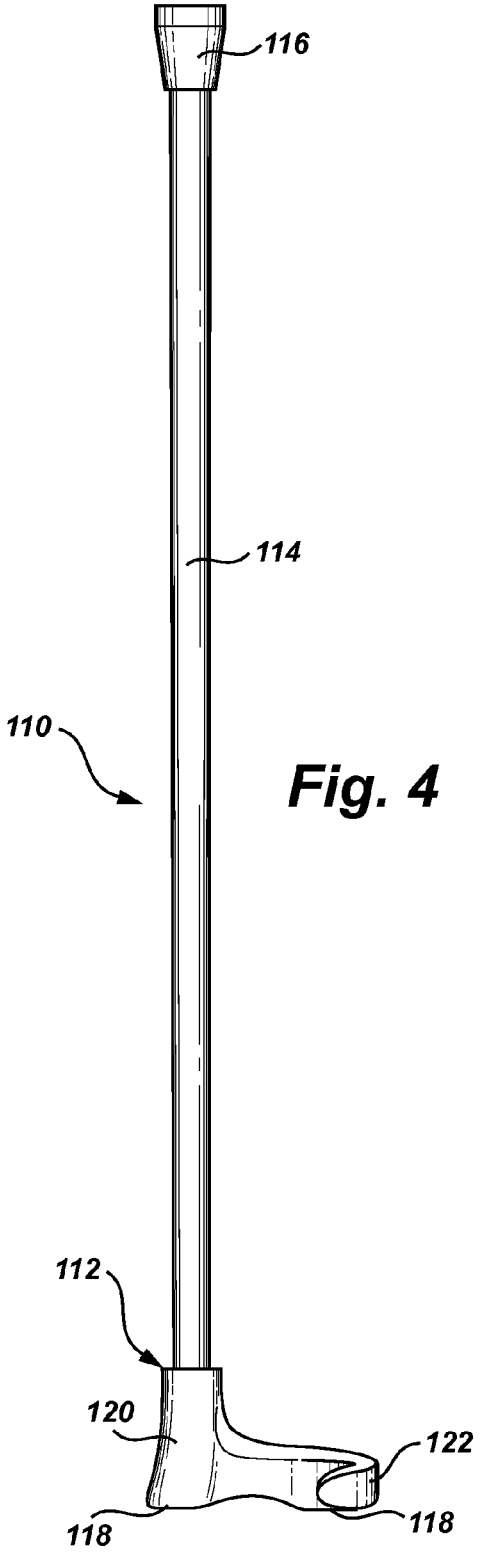
FIG. 4 is a side elevation view of the walking cane of FIG. 3.
Figure 5:
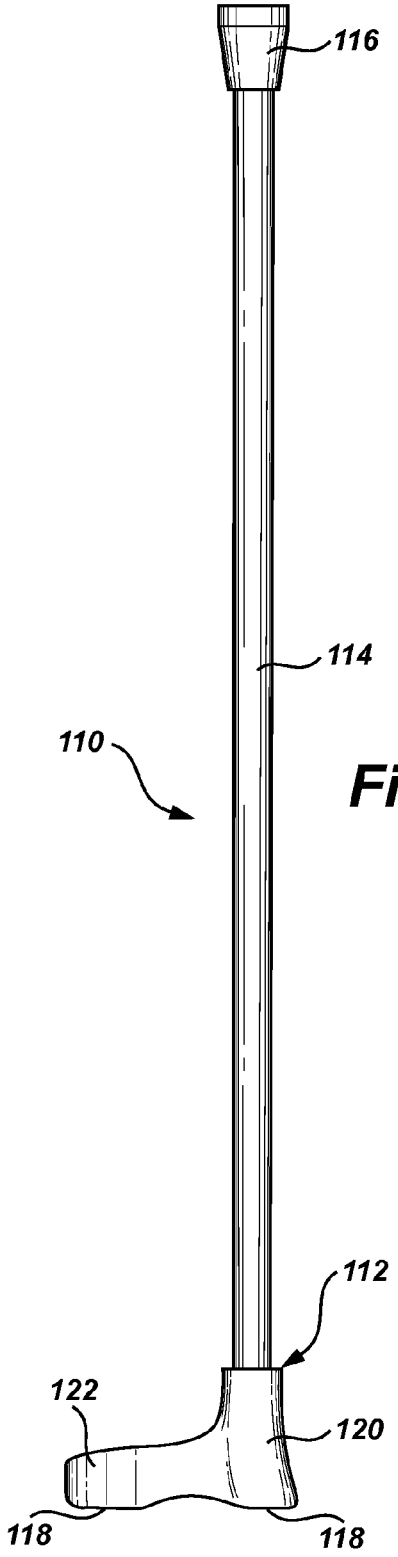
FIG. 5 is an alternative side elevation view of the walking cane of FIG. 3.

In one embodiment, the handle portion 112 has a static shape, with no articulating components. The handle portion 112 may be a single molded piece, and could optionally be formed of polymeric material, such as an elastomer or elastomeric-based material. In another embodiment, the handle portion 112 is molded out of rigid plastic and includes a soft dual injection material that is comfortable to a user's hand, similar to materials used in golf club handle technologies. The non-articulating handle portion 112 eliminates the complexity of conventional multifaceted walking canes, and eliminates the need for moving and frangible components. In one embodiment as shown in FIGS. 3-5, at the top end of the handle portion 112, a planar surface portion 118 may extend along the length of or a portion of the handle 112. The planar surface portion 118 may be oriented such that when the walking cane 110 is inverted and the handle portion 112 is placed on the ground, the ground and the planar surface portion 118 are parallel or substantially parallel.

In one exemplary arrangement, the handle portion 112 includes a first support portion 120 disposed underneath and supporting the shaft portion 114 when the walking cane 110 is inverted and placed handle-side down on the ground. A top part of the first support portion 120 includes a planar surface portion 118 which can rest on the ground and provide a stable base from which the shaft portion 116 can be supported when it extends upwards.

The handle portion 112 may also include a second support portion 122 which is located at a position away from the shaft portion 116 in a radial direction. A top part of the second support portion 122 also includes a planar surface portion 118 which can rest on the ground and provide a base to support the shaft portion 116 extending upwards in a substantially perpendicular manner. Disposed between and interconnecting the first 120 and second 122 support portions is a grasping portion 124 which is configured to be easily grasped by a user. In one arrangement, the grasping portion 124 does not include a planar surface portion 118, but is rounded to ergonomically receive a user's hand. For example, the handle portion 112 is ergonomically shaped to conform to a user's hand. In another arrangement, the grasping portion 124 also includes a planar surface portion 118 on its top side and a rounded portion underneath. In one embodiment, the first 120 and second 122 portions and the grasping portion 124 are a single integrated unit.

The grasping portion 124 may be shaped to receive the palm of a user's hand, and the first support portion 122 is configured to be disposed between the user's thumb and index finger. The second support portion 122 may extend around the palm of a user's hand when the user grasps the grasping portion 124. The shape of the handle portion 112 in such an arrangement allows for a user to grip the walking cane 110 and support one's weight without having to bend the wrist and apply undue pressure thereon.

Figure 6:
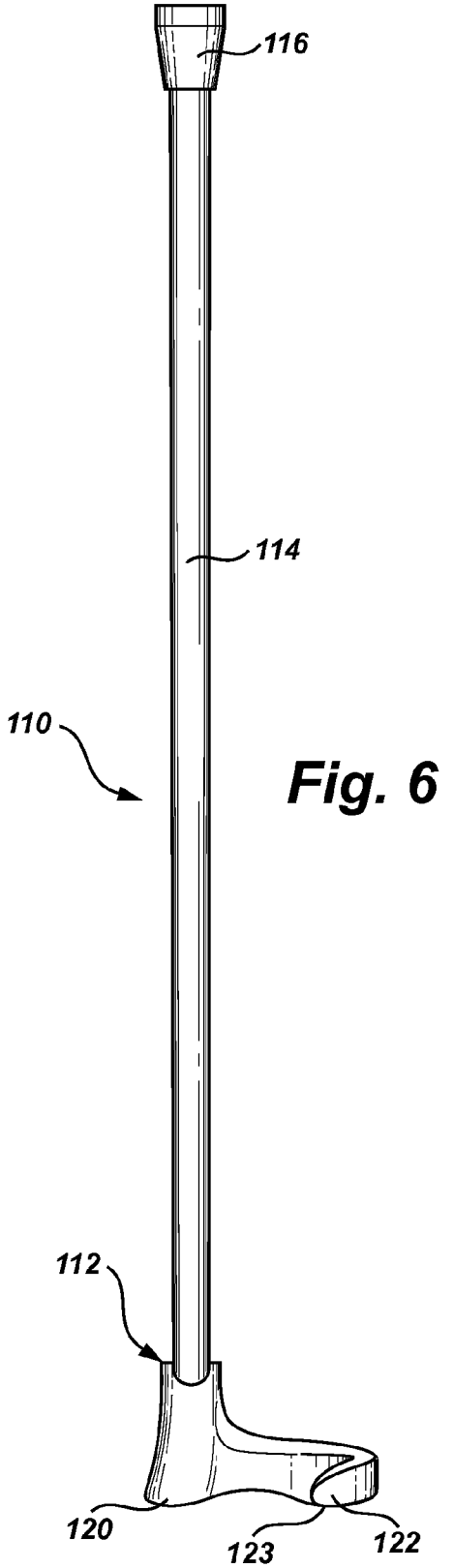
FIG. 6 is a side elevation view of another embodiment of a walking cane.
Figure 7:
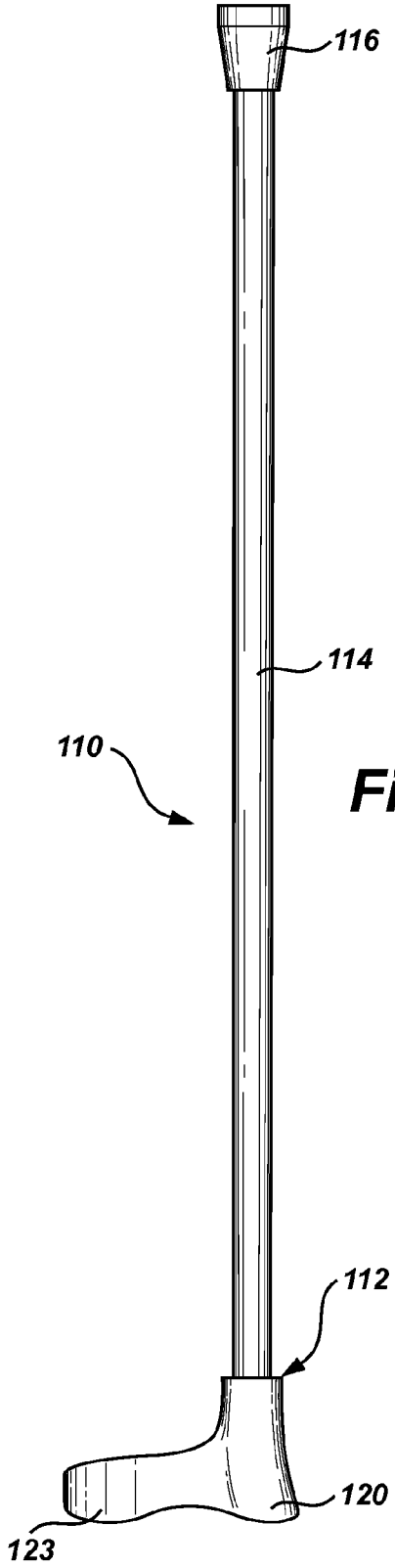
FIG. 7 is an alternative side elevation view of the walking cane of FIG. 6.

In another embodiment as shown in FIGS. 6 and 7, the handle portion 112 includes three or more ground engaging portions, which include first support portion 120, second support portion 122, and an intermediate third support portion 123. The first, second and third support portions 120, 122, 123 may form a triangulating base that can rest on the ground and provide a stable support for the shaft portion 114 to be disposed upward when the walking cane 110 is inverted and placed handle-side down. The three support portions 120, 122, 123 provide three points of contact for the handle portion 112 to rest on the ground, and may or may not include a planar surface, but may be rounded for the comfort of the user when the walking cane 110 is in use. In other embodiments, more than three support portions may be located on the handle portion 112 for supporting the shaft portion 114 in a substantially perpendicular direction when the walking cane 110 is inverted and placed handle-side down on the ground.

In the embodiment of FIGS. 6 and 7, the three support portions 120, 122, 123 may be rounded or otherwise contact the ground over a small surface area to keep the handle portion 112 sanitary, such as when used in public restrooms and the like. In one embodiment, the three (or more) points of contact with the ground of the three support portions 120, 122, 123 may be positioned away from the grasping portion 124 so a user does not handle the three ground points of contact.

The walking cane 110 of the present disclosure has a handle portion 112 that is shaped to provide a stable base upon which the shaft portion 114 is balanced and placed in an upright storage position. The walking cane 110 in such a storage position takes a minimal amount of space in the radial direction, and does not prove to be as problematic an obstacle to those that walk around the cane in the storage position compared to conventional canes that must lean against a wall or furniture, which may obstruct walkways.

The various configurations of the handle portion 112 as described herein and depicted in the Figures, as well as the description of the combination of the first 120, second 122 and third 123 support portions with the planar surface portion 118 are examples of means for self-standing to allow the walking cane to be self-standing when inverted.

While specific embodiments of walking canes have been illustrated and described, it is to be understood that the invention claimed hereinafter is not limited to the precise configuration and components disclosed. Various modifications, changes, and variations apparent to those of skill in the art may be made in the arrangement, operation, and details of the methods and systems disclosed.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the invention as claimed hereinafter. In other words, various modifications and improvements of the embodiments specifically disclosed in the description above are within the scope of the appended claims. Note that elements recited in means-plus-function format are intended to be construed in accordance with 35 U.S.C. §112 ¶6.

What is claimed is:

1. A walking cane, comprising:

a non-articulating, integrally formed handle portion having a static handle shape that is configured to be grasped by a user; and a shaft portion extending from the handle portion and configured to extend between the handle portion and the ground when the walking cane is in use;

wherein the handle portion includes a grasping portion extending radially between first and second support portions, the grasping portion is shaped to be ergonomically grasped by a user, the first support portion disposed underneath and supporting the shaft portion when the walking cane is inverted and placed on the ground, the first support portion configured to be disposed between the user's thumb and forefinger, the second support portion located in a radial direction away from the shaft portion and configured to be disposed behind the user's palm and a third support portion configured to be disposed behind the user's palm, and the handle portion is shaped in such a manner to allow the walking cane to be self-standing when inverted and the handle portion is placed on the ground.

2. The walking cane of claim 1, wherein the shaft portion extends substantially perpendicular from the ground when the walking cane is inverted and placed on the ground.

3. The walking cane of claim 1, wherein the handle portion is a single molded piece.

4. The walking cane of claim 1, wherein the handle portion comprises a planar surface portion which is parallel to the ground when the walking cane is inverted and placed on the ground.

5. The walking cane of claim 4, wherein the handle portion comprises a rounded grasping portion positioned between the first and second support portions, the first and second support portions comprising the planar surface.

6. The walking cane of claim 1, wherein the first, second and third support portions provide triangulating points of contact to support the shaft portion when the walking cane is inverted and placed on the ground.

7. The walking cane of claim 1, wherein the shaft portion has an adjustable length.

8. A walking cane, comprising:

a non-articulating handle portion that is configured to be grasped by a user, wherein the handle portion comprises first, second and third support portions forming triangulating points of contact with the ground over a relatively small surface area to allow the walking cane to be self-standing when inverted and the handle portion is placed on the ground, the first, second and third support portions positioned away from a grasping portion configured to be grasped by a user, the grasping portion extending radially between at least the first and second support portions and the grasping portion configured to avoid contact with the ground to keep the handle portion sanitary when the walking cane is inverted and the handle portion is placed on the ground; and a shaft portion extending from the handle portion and configured to extend between the handle portion and the ground when the walking cane is in use, and wherein the shaft portion extends substantially perpendicular from the ground when the walking cane is inverted and placed on the ground and the second support portion located at a position away from the shaft portion in a radial direction.

9. The walking cane of claim 8, wherein the handle portion is a single molded piece.

10. The walking cane of claim 8, wherein at least one support portion comprising a planar surface, the planar surface being parallel to the ground when the walking cane is inverted and placed on the ground.

11. The walking cane of claim 10, wherein the handle portion comprises a rounded grasping portion positioned between first and second support portions, the grasping portion shaped to be ergonomically grasped by a user, the first and second support portions comprising the planar surface.

12. The walking cane of claim 8, wherein the handle portion comprises a rounded grasping portion positioned between the first and second support portions, the grasping portion shaped to be ergonomically grasped by a user, the first support portion disposed underneath and supporting the shaft portion when the walking cane is inverted and placed on the ground, the second portion located in a radial direction away from the shaft portion.

13. A walking cane, comprising:

an integrally formed handle portion having a static handle shape with a rounded portion that is configured to be grasped by a user; and a shaft portion extending from the handle portion and configured to extend between the handle portion and the ground when the walking cane is in use;

wherein the rounded grasping portion extending radially between first and second support portions, the rounded grasping portion is shaped to be ergonomically grasped by a user, the second support portion located in a radial direction away from the shaft portion, and the first support portion disposed underneath and supporting the shaft portion when the walking cane is inverted and placed on the ground, the first support portion configured to be disposed between the user's thumb and forefinger, the second support portion configured to be disposed behind the user's palm and a third support portion configured to be disposed behind the user's palm, and wherein the handle portion is shaped in such a manner to allow the walking cane to be self-standing when inverted and the handle portion is placed on the ground and wherein the shaft portion extends substantially perpendicular from the ground when the walking cane is inverted and placed on the ground.

14. The walking cane of claim 13, wherein the handle portion is a single molded piece.

15. The walking cane of claim 13, wherein the first, second and third support portions provide triangulating points of contact to support the shaft portion when the walking cane is inverted and placed on the ground.

* * * * *